United States Patent [19]

Chapman

[11] 4,133,500

[45] Jan. 9, 1979

[54] TOY KITES

[75] Inventor: Thomas M. Chapman, Horton, England

[73] Assignee: The Mettoy Company Limited, Northampton, England

[21] Appl. No.: 834,512

[22] Filed: Sep. 19, 1977

[30] Foreign Application Priority Data

Sep. 20, 1976 [GB] United Kingdom ..... 38930/76

[51] Int. Cl.[2] ..... B64C 31/02; B64C 31/06

[52] U.S. Cl. ..... 244/153 R; 46/77; 46/81; 244/16; 244/155 A; 244/63; 244/DIG. 1

[58] Field of Search ..... 244/153 R, 153 A, 154, 244/155 R, 155 A, DIG. 1, 3, 1 TD, 16, 93, 63, 49; 46/76 R, 79, 81; 294/83 R

[56] References Cited

U.S. PATENT DOCUMENTS

| | | | |
|---|---|---|---|
| 3,204,368 | 9/1965 | Effinger, Jr. et al. | 244/DIG. 1 |
| 3,507,150 | 4/1970 | Stengel | 244/49 |

*Primary Examiner*—Galen L. Barefoot

*Attorney, Agent, or Firm*—Watson, Cole, Grindle & Watson

[57] ABSTRACT

A toy kite has the general form of a hang glider and has a tow line which is releasable from the kite when in flight by slackening the tension in the tow line. Spars of the kite frame are hinged together by unitary plastic hinges and the frame can be folded and erected by moving a slider along a main spar. A pilot figure suspended in a harness below the kite is adjustable to alter the trim.

9 Claims, 5 Drawing Figures

TOY KITES

This invention relates to toy kites.

A toy kite in accordance with the invention has the general form of a hang glider and has a tow line and means for attaching the tow line to the kite in such a manner that the tow line can be released from the kite while the kite is flying, under the control of an operator.

A kite of the above form can be launched and flown as a kite and released from its tow line at will to come to earth as a hang glider.

In a preferred embodiment of the invention a delta wing toy kite has a frame including a longitudinal main spar, two side spars and lateral bracing spars interconnected by simple hinge fittings, each preferably moulded in one piece from resilient synthetic plastics material, enabling the glider to be readily erected or collapsed for transport by simple manipulation.

The releasable means attaching the tow line to the kite preferably includes a resilient member in the form of an open hook which is normally engaged firmly and held stressed by a tow ring attached to the tow line when the line is under tension, but which springs from the stressed position to release the tow ring when the tension in the tow line is relaxed. The tow ring and hook provide a simple and convenient arrangement for release of the tow line at the will of the operator.

One form of toy hang glider/kite in accordance with the invention is described below, by way of example, with reference to the accompanying drawings, in which.

Figure 1:
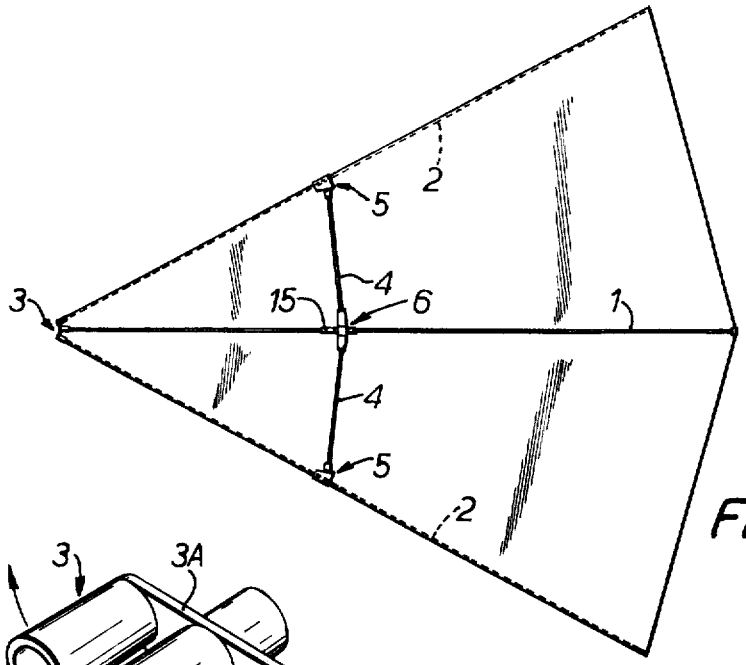
FIG. 1 is a diagrammatic top plan view of the kite.

The toy hang glider/kite shown in the drawings comprises a longitudinal main spar 1 and two side spars 2 all connected hingedly together by a nose fitting 3, and two bracing spars 4 hingedly connected to the respective side spars 2 by hinge fittings 5 and to a centre fitting 6 which is slidable along the main spar 1 and permits hinging movement of the bracing spars 4 between the erected position of the kite shown in FIG. 1 and a folded position in which the five spars lie alongside each other, for easy packaging and transport of the kite.

Figure 2:
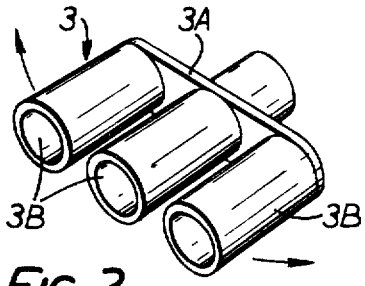
FIGS. 2 and 3 are perspective views of a nose-fitting.
Figure 3:
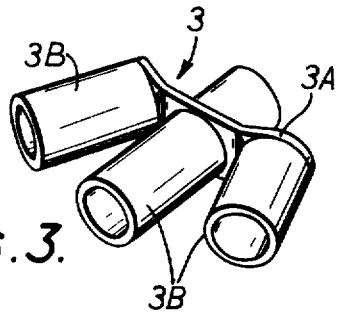

The nose fitting 3 is illustrated in FIGS. 2 and 3 in its folded and erected condition, respectively. It consists of a moulding of resilient synthetic resin material having a flexible plate portion 3A formed with three sockets 3B for receiving the leading ends of the spars 1 and 2.

Figure 4:
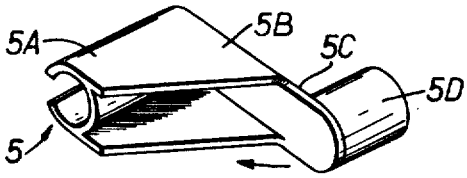
FIGS. 4 and 5 are perspective views of a side hinge fitting.
Figure 5:
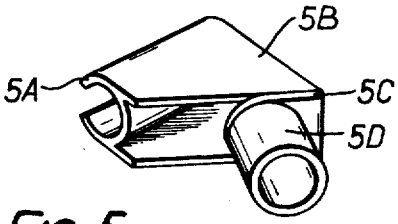

One hinge fitting 5 is shown in FIGS. 4 and 5, again in its folded and erected condition, comprises a socket portion 5A open along one side and having sharp axial edges to bite into the side spar, a channel section fillet portion 5B, an integral hinge flap 5C and a socket 5D to receive the outer end of the adjacent bracing spar 4, which can hinge through some 120° or so relative to the side spar.

Figure 6:
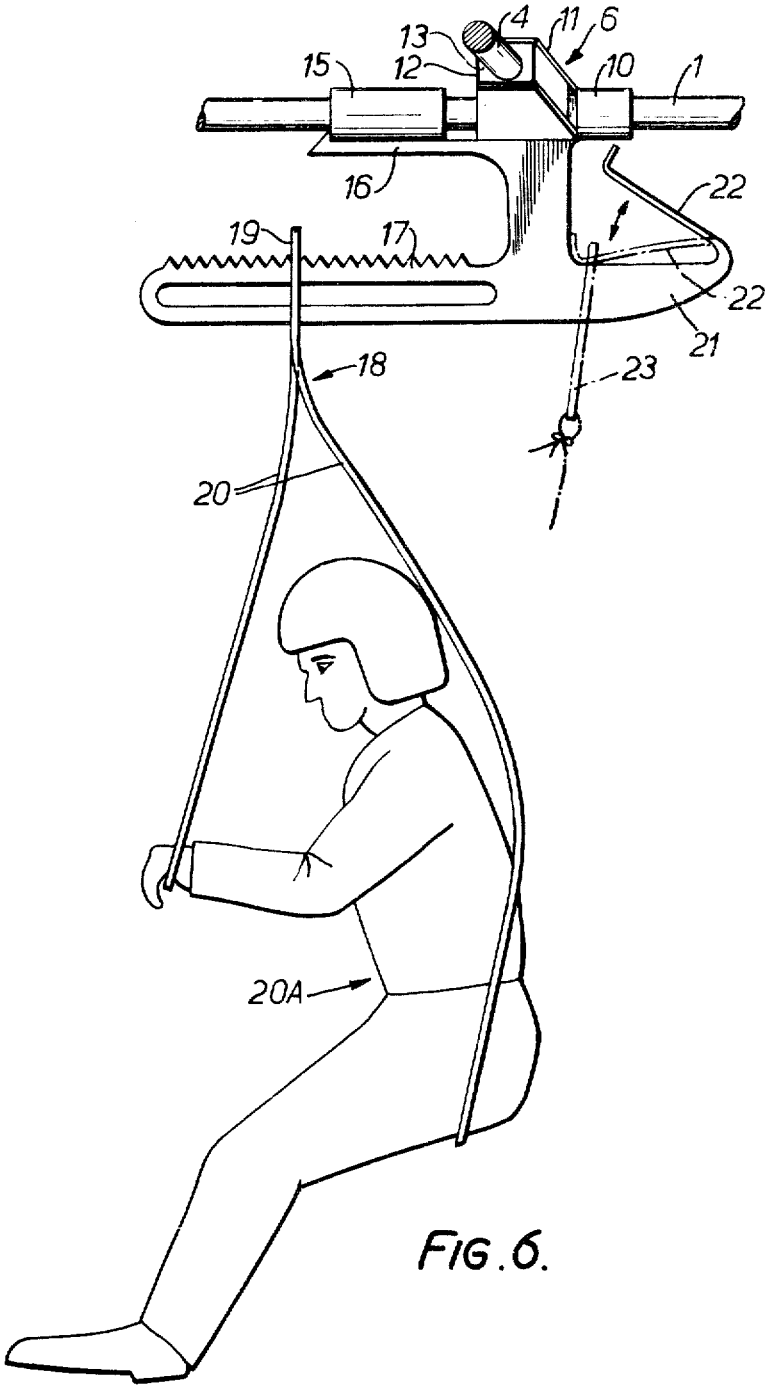
FIGS. 6 and 7 are side and perspective views of a centre fitting.
Figure 7:
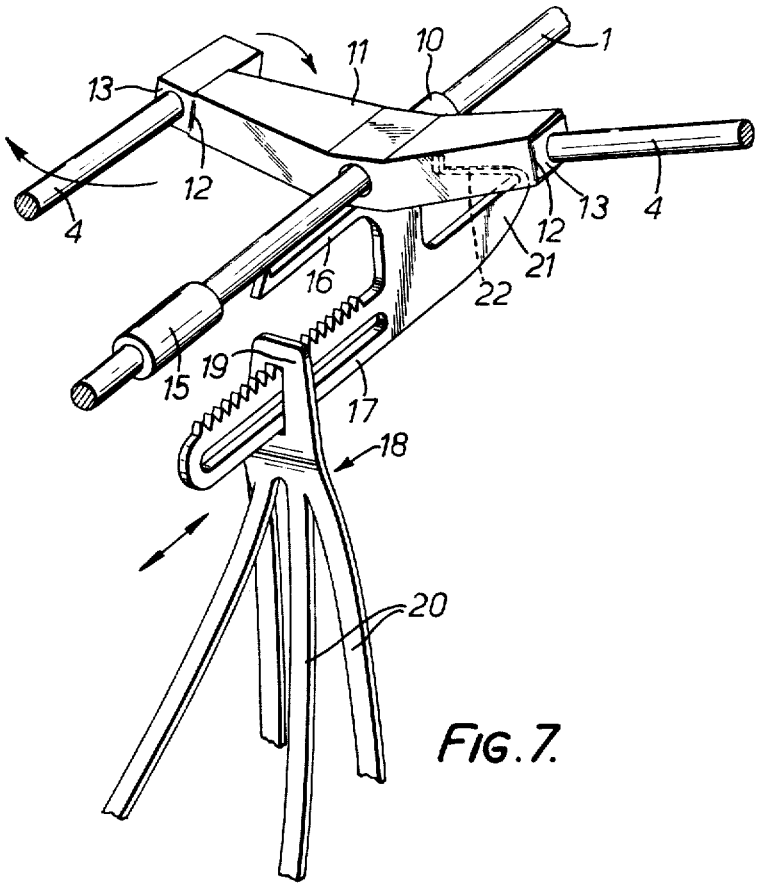

The centre fitting 6 is illustrated in FIGS. 6 and 7, and comprises a main socket 10 slidably mounted on the main spar 1 and having a pair of winglike channel portions 11 extending laterally on opposite sides thereof. At its outer end, each portion 11 terminates at an integral hinge 12 and a socket 13 which receives the inner end of the adjacent bracing spar 4. In FIG. 7, for the sake of illustration one spar 4 is shown in its erected position in which it extends laterally of the main spar, and the other is shown in its folded position parallel with the main spar.

In the erected position, the fitting 6 abuts a stop sleeve 15 secured to the main spar, and the fitting 6 has a forwardly extending resilient latch 16 for engagement with the sleeve 15 to lock the fitting 6 in its forward position.

The kite also has a delta wing or sail of generally known form, preferably and conveniently of thin film material such as polythene film.

Figure 8:
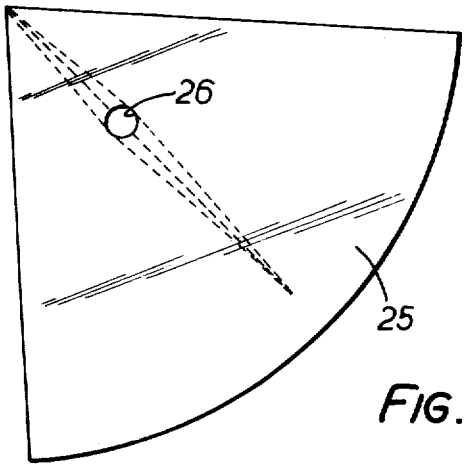
FIG. 8 is a plan view of the kite sail.

The sail is formed from a sector shaped piece of film material 25 (FIG. 8) which at the straight edges is wrapped around the side spars and welded back upon itself. A hole 26 is provided for the main spar to pass through the sail from the underside at the tail to the top-side at the nose. The film is folded along the broken lines shown in FIG. 9 to form a pleat, the folds of which are welded together, so that an area of greater tension is formed at the nose when the glider is opened. In this way an area of positive lift is developed as the skin remains taut at the front of the sail.

The kite is readily erected and folded by movement of the fitting 6 along the main spar 1, forwardly for erection, and rearwardly for folding, relative movement of the spars being permitted by the integral hinges of the fittings 3, 5 and 6 described above.

Depending from the socket 13 of the centre fitting is a bracket having a forwardly extending support 17 whose upper edge is serrated. A pilot-harness 18 is suspended from the support and is adjustable in position therealong to trim the kite. The harness 18 has an apertured plate 19 at its upper end for engagement over the support 17, and four integral harness straps 20 in which a pilot figure 20A is suspended. The engagement between the plate 19 and the serration of support 17 permits some fore-and-aft swinging of the harness and pilot figure in flight.

At the rear of the bracket is a rearward extension 21 and a resilient open hook 22 for cooperation with a tow ring 23.

In use of the kite, the two ring is engaged over the hook 22 and the line passes forwardly beside the harness straps 20, and as long as tension is maintained on the line, the ring 23 remains engaged by the hook 22 and is held down against extension 21, as shown in dotted lines in FIG. 6. The user can release the kite at will by allowing the line to slacken, whereupon the hook 22 springs up, causing the tow ring 23 to slide rearwardly and thereby disengage itself from the kite, which thereafter flies free as a hang glider.

What is claimed is:

1. A toy kite having a frame, a sail attached to the frame and a tow line having a part fixedly secured to the tow line and attached to the kite, the improvement which comprises a kite having the general form of a hang glider and resilient means secured to the kite for releasing said tow line from the kite when in flight under the control of an operator, said tow line part being adapted to engage said resilient means to hold said resilient means in a stressed condition when said tow line is under tension, and said resilient means moving from said stressed position to disengage said part therefrom when said tow line is relaxed.

2. A toy kite according to claim 1, wherein said frame comprises a main spar with front and rear ends, two side spars each having a rear end and a front end pivotally connected to said main spar at said front end thereof, two laterial spars each having a first end hinged to one of said side spars intermediate the front and rear ends thereof, and a slide member slidable along the main spar, each lateral spar having a second end hinged to said slide member, and said slide member being slidable to and fro along the kite to erect and fold the frame.

3. A toy kite according to claim 1, wherein said sail has an area of greater tension at the nose of the kite whereby to provide an area of positive lift.

4. A toy kite according to claim 1, wherein a weight is suspended beneath the kite and means is provided for adjusting the position of said weight for adjusting the trim of the kite.

5. A toy kite according to claim 6, wherein said weight comprises a pilot figure suspended beneath the kite by a harness and capable of some fore-and-aft swinging motion when the kite is in flight.

6. A toy kite according to claim 5, wherein said adjustment means comprises a bracket carried by the kite and having an upper surface provided with a series of notches, said harness being selectively engageable in any one of said notches.

7. A toy kite according to claim 2, wherein the side spars are hinged to said main spar and said lateral spars are hinged to said side spars and said slide member by hinges of unitary construction.

8. A toy kite having a frame, a sail attached to the frame and a tow line attached to the kite, the improvement which comprises the kite having the general form of a hang glider and means for releasing said tow line from the kite when in flight under the control of an operator, said means comprising a tow ring fixed to said tow line and a resilient hook carried by said kite, said hook being firmly engageable by said tow ring to be held in a stressed position thereby when said tow line is under tension, and said hook being movable from said stressed position under its own resilience to disengage said tow ring when said tension in said tow line is relaxed.

9. A toy kite having a frame, a sail attached to the frame and a tow line attached to the kite, the improvement which comprises the kite having the general form of a hang glider, having means for releasing said tow line from the kite when in flight under the control of an operator, and having a weight suspended beneath the kite and means for adjusting the position of said weight for adjusting the trim of the kite, said weight comprising a pilot figure suspended beneath the kite by a harness and capable of some fore-and-aft swinging motion when the kite is in flight, and said adjustment means comprising a bracket carried by the kite and having an upper surface provided with a series of notches, said harness being selectively engageable in any one of said notches.

* * * * *